US008146303B2

(12) United States Patent
Gibson et al.

(10) Patent No.: US 8,146,303 B2
(45) Date of Patent: Apr. 3, 2012

(54) INTEGRATED DECKING MEMBER FASTENING TRACK

(76) Inventors: Brent Alan Gibson, Grants Pass, OR (US); Donald George Hinkle, Merlin, OR (US)

( * ) Notice: Subject to any disclaimer, the term of this patent is extended or adjusted under 35 U.S.C. 154(b) by 0 days.

(21) Appl. No.: 12/807,897

(22) Filed: Sep. 16, 2010

(65) Prior Publication Data

US 2011/0067335 A1 Mar. 24, 2011

Related U.S. Application Data

(60) Provisional application No. 61/277,038, filed on Sep. 21, 2009.

(51) Int. Cl.

| | |
|---|---|
| ***E04F 11/16*** | (2006.01) |
| ***E04F 15/00*** | (2006.01) |
| ***E04B 2/30*** | (2006.01) |
| ***E04B 1/38*** | (2006.01) |
| ***E04B 2/00*** | (2006.01) |

(52) U.S. Cl. ..... 52/177; 52/489.1; 52/489.2; 52/480; 52/512; 52/586.1; 52/586.2; 52/483.1; 52/582.1; 52/650.3

(58) Field of Classification Search ..... 52/177, 52/489.1, 489.2, 480, 512, 586.1, 586.2, 52/483.1, 582.1, 650.3, 765, 775; 411/457, 411/458, 460, 470, 461, 466

See application file for complete search history.

(56) References Cited

U.S. PATENT DOCUMENTS

| | | | | | |
|---|---|---|---|---|---|
| 876,399 | A * | 1/1908 | Robinson | 52/714 |
| 1,888,611 | A * | 11/1932 | Wolfson | 52/512 |
| 2,065,525 | A * | 12/1936 | Hamilton | 411/460 |
| 2,620,705 | A * | 12/1952 | Papa et al. | 411/460 |
| 2,848,758 | A * | 8/1958 | Chisholm | 52/364 |
| 3,267,630 | A * | 8/1966 | Omholt | 52/506.1 |
| 3,577,694 | A * | 5/1971 | Omholt | 52/506.1 |
| 3,619,963 | A * | 11/1971 | Omholt | 52/481.1 |
| 4,255,914 | A * | 3/1981 | Seipos | 52/489.2 |
| 4,272,938 | A * | 6/1981 | Seipos | 52/509 |
| 4,616,462 | A * | 10/1986 | Abendroth | 52/509 |
| 4,703,601 | A * | 11/1987 | Abendroth | 52/509 |
| 4,777,778 | A * | 10/1988 | Taupin | 52/714 |
| 4,925,141 | A * | 5/1990 | Classen | 248/217.2 |
| 5,390,457 | A * | 2/1995 | Sjolander | 52/387 |
| 5,842,319 | A * | 12/1998 | Ravetto | 52/715 |
| 5,997,209 | A * | 12/1999 | Sachs | 403/388 |
| 6,094,882 | A * | 8/2000 | Pervan | 52/745.19 |
| 6,266,937 | B1 * | 7/2001 | Watanabe | 52/489.2 |
| 6,374,552 | B1 * | 4/2002 | Price | 52/169.12 |
| 6,416,269 | B1 * | 7/2002 | Martel et al. | 411/461 |
| 6,880,305 | B2 * | 4/2005 | Pervan et al. | 52/480 |
| 7,251,918 | B2 * | 8/2007 | Reif et al. | 52/714 |
| 7,398,623 | B2 * | 7/2008 | Martel et al. | 52/489.2 |
| 7,805,902 | B2 * | 10/2010 | Martel | 52/489.1 |
| 7,886,494 | B1 * | 2/2011 | Schott | 52/489.1 |
| 8,006,458 | B1 * | 8/2011 | Olofsson et al. | 52/582.1 |
| 8,011,153 | B2 * | 9/2011 | Orchard | 52/489.1 |
| 2001/0015042 | A1 * | 8/2001 | Ballard | 52/589.1 |
| 2005/0252154 | A1 * | 11/2005 | Martel et al. | 52/712 |
| 2006/0156666 | A1 * | 7/2006 | Caufield | 52/483.1 |
| 2006/0283126 | A1 * | 12/2006 | Puerta | 52/582.1 |

* cited by examiner

*Primary Examiner* — Mark Wendell

(57) ABSTRACT

The deck track is a steel track having a series of formed receivers and fasteners. The deck track will allow a deck system to be installed without the use of any mechanical fasteners such as screws, nails or individual fasteners. The upper fasteners and receivers, referred to as tangs, maintain the desired gap between composite deck boards for the life of the deck.

18 Claims, 3 Drawing Sheets

FIG. 6
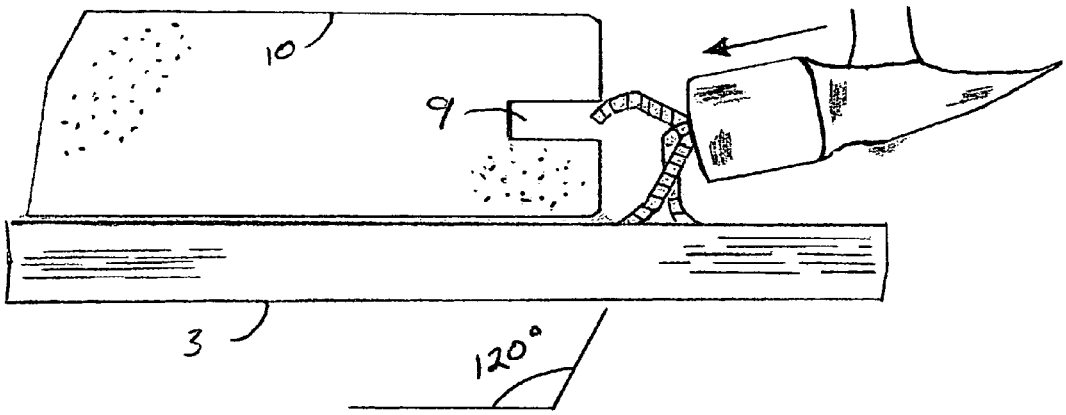
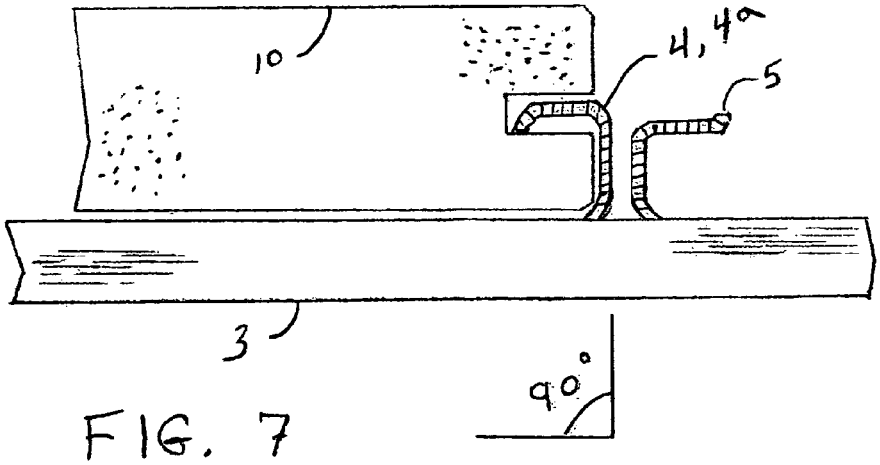
FIG. 7

INTEGRATED DECKING MEMBER FASTENING TRACK

CROSS-REFERENCE TO RELATED APPLICATIONS

The present application claims priority benefit, with regard to all common subject matter, of earlier filed U.S. provisional patent application titled "DECK TRACK" application Ser. No. U.S. 61/277,038, filed Sep. 21, 2009. The earlier filed provisional patent application is hereby incorporated into the present application by specific reference.

BACKGROUND OF THE INVENTION

1. Field of Invention

The present invention relates to a deck fastening track for securing slotted or grooved decking members to an underlying supporting member.

2. Description of the Prior Art

The decking industry is increasingly utilizing composite materials as the deck material of choice. Reasons for this trend include durability issues and an increasingly environmentally conscious consumer base. As a deck material, wood is both limited in its durability and longevity, as well as inconsistent in quality. Furthermore, many consumers are choosing composite building materials as a means of "building green," that is, choosing more environmentally responsible and resource-efficient practices in the design, construction, operation, maintenance, renovation, and demolition of homes and other related structures. This practice allows consumers to expand and complement the classical building design concerns of economy, utility, durability, and comfort.

Unlike conventional lumber deck surfaces that are nailed or screwed to a joist or other supporting member, composite deck boards are typically secured with hidden fastening systems featuring individual clips. This application of hidden fastening systems featuring individual clips provides a more "finished" appearance because the surfaces of the installed composite deck boards display no evidence of having been nailed or screwed down. Despite this cosmetic advantage, however, utility limitations are encountered with hidden fastening systems featuring individual clips. (See e.g., U.S. Pat. No. 6,416,269B1; U.S. 2007/0289232A1).

Hidden fastening systems featuring individual clips have notable limitations, including: (1) insignificant fastening force resulting in uneven gaps and loose deck boards; (2) individual clip application which increases installation time of deck boards; and (3) the requirement of repetitive hand motions using drills and screws for installation, which increases fatigue on the applicator's hands and lower back. The present invention addresses the above limitations and supports the decking industry's move toward composite or other similar innovative decking products.

SUMMARY OF THE INVENTION

An embodiment of the present invention relates to an integrated decking member fastening track, herein referred to as "fastening track," or "track." The fastening track is a single unit. The number of units of fastening track to be used in a particular application depends on the type and/or size of the application. The track itself is 3-sided, comprising a top panel and two side panels. The track contains integrated decking member fasteners for receiving and fastening slotted decking members sequentially. The term "integrated decking member fasteners" includes both receiving tangs and fastening tangs, grouped together along a single track so as to accept and secure individual sections of slotted decking members. The integrated fasteners are formed out of the material comprising the top panel of the track. "Slotted decking members" refers to elongated boards, planks, or other construction members having generally flat bottom and top surfaces, such as those suitable for use as a deck surface, where one or both of the side edges of the members contain horizontal slots or grooves. The two side panels are connected with the top panel at an inward, slightly acute angle, and contain lower tangs for securing an entire track unit to a supporting member.

The individual tracks are mounted atop laterally adjacent joists or other supporting members, which are fastened onto ledger boards running perpendicular to the supporting members. The leading edge of each track is aligned on the supporting members so as to ensure the decking members remain parallel throughout deck installation. An aligned track is then pressed down onto its supporting member, thereby engaging the track's lower tangs, which dig into the supporting member and lock the track into position.

After a selected number of tracks are pressed into position atop supporting members, a decking member is inserted into the aligned tracks by lowering the decking member onto the receiving tangs of each track, such that the receiving tangs slip into the horizontal slot along the decking member. The decking member is then allowed to lay flat, abutting twin fastening tangs opposite the receiving tangs. Once in this position, the twin fastening tangs become aligned with the horizontal slot along the side of the decking member. Upon alignment, the twin fastening tangs are securely and permanently bent into the slotted groove of the decking member using a hammer or other appropriate tool.

Subsequently, a second decking member is lowered onto the next row of receiving tangs and the above process is repeated. The rigid, right angle position of the receiving tangs throughout the installation process ensures proper horizontal alignment of all installed decking members.

BRIEF DESCRIPTION OF THE DRAWINGS

In the drawings, which form a part of this specification:

FIG. 6 is a side elevation view of an engaged slotted decking member with said fastening tang in "open" position upon said embodiment with illustration of striking direction for engaging said fastening tang into "closed" position.

FIG. 7 is side elevation view of an engaged slotted decking member with said fastening tang in closed position, with the leading edge of said tang penetrating lower surface of said slot.

Figure 1:
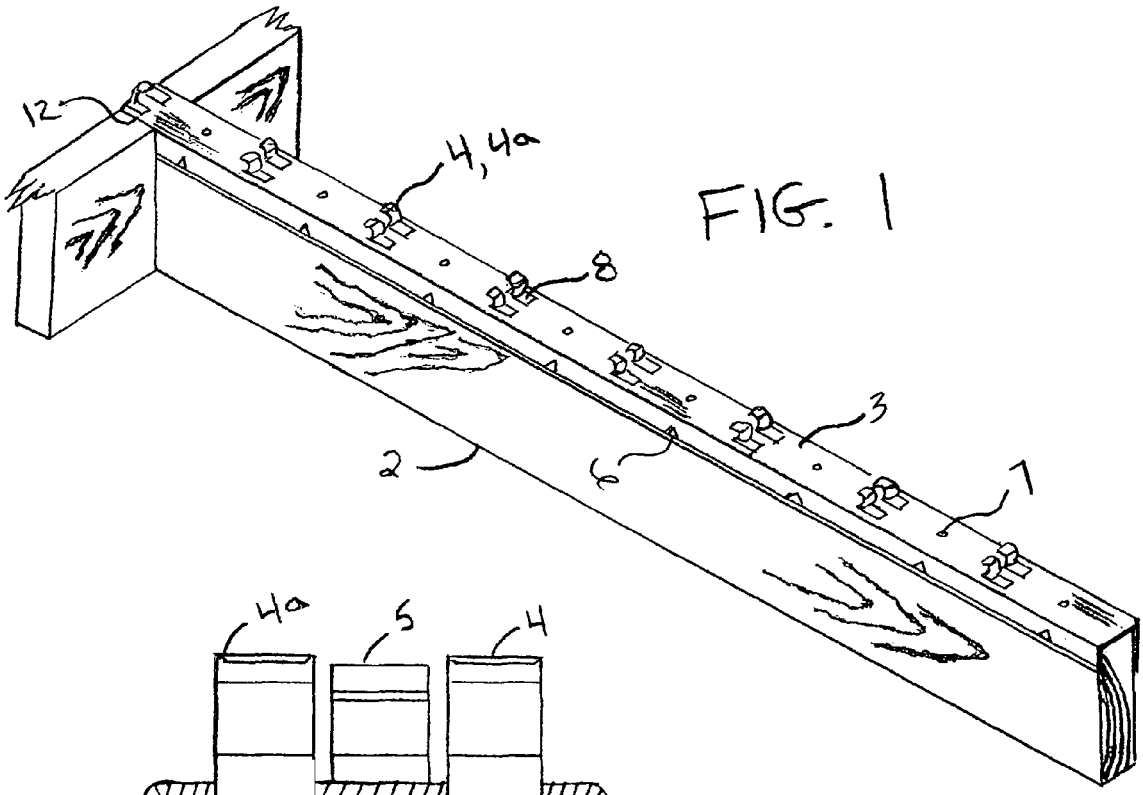
FIG. 1 is a perspective view of an integrated decking member fastening track, according to an embodiment of the present invention, shown affixed atop a supporting member with alignment receiver against header board.
Figure 4:
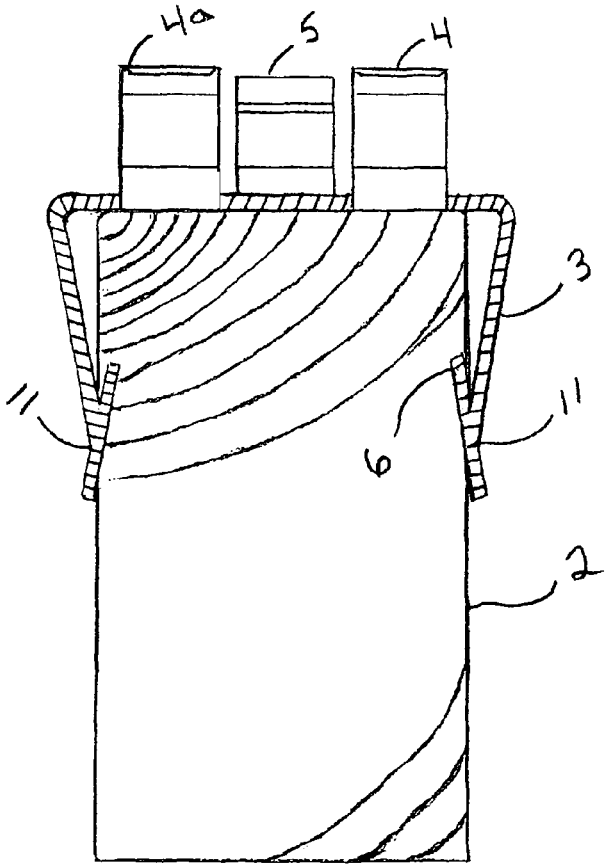
FIG. 4 is a cross-sectional view of the fastening track, shown affixed atop a supporting member, and illustrating a compression fit of the side panels containing lower tangs engaged into said supporting member.
Figure 2:
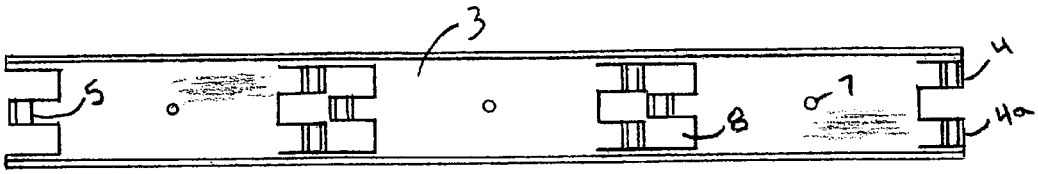
FIGS. 2 and 3 are top plan and side elevation views, respectively, of the fastening track of FIG. 1.

The drawings do not limit the present invention to the specific embodiments disclosed and described herein. The drawings are not to scale, and only serve to clearly illustrate the principles of the invention.

DETAILED DESCRIPTION OF PRESENT INVENTION SPECIFICATIONS

Referring to FIGS. 1-7, the present invention relates to a novel integrated decking member fastening track 3 (hereinafter referred to as "fastening track" or "track") for connecting successive slotted decking members 10 to an underlying joist or other supporting member 2.

The first step in using the present invention involves mounting the tracks 3 atop laterally adjacent joists or other supporting members 2, which are fastened onto ledger boards running perpendicular to the supporting members 2. The underlying supporting members 2 are of 1.5" thickness and typically nominal treated lumber, but can be any appropriate structural material measuring 1.5" thickness. The spacing of underlying supporting members 2 depends on the anticipated deck size as well as anticipated load carried thereon. The leading edge of each track 3 is aligned on the supporting members 2 so as to ensure that the decking members 10 remain parallel throughout the deck installation. An aligned track 3 is then pressed down onto its supporting member 2, thereby engaging the track's lower tangs 11, which dig into the supporting member 2 and lock the track 3 into position.

The top panel of each track 3 contains multiple openings 7 allowing for passage of elongated connectors for additional, discretionary support to said supporting members 2.

Figure 3:
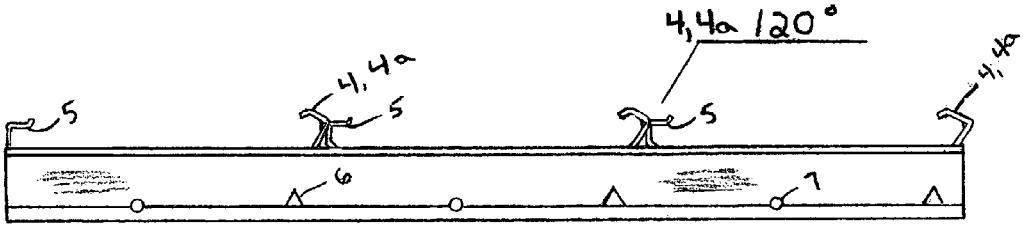
Figure 5:
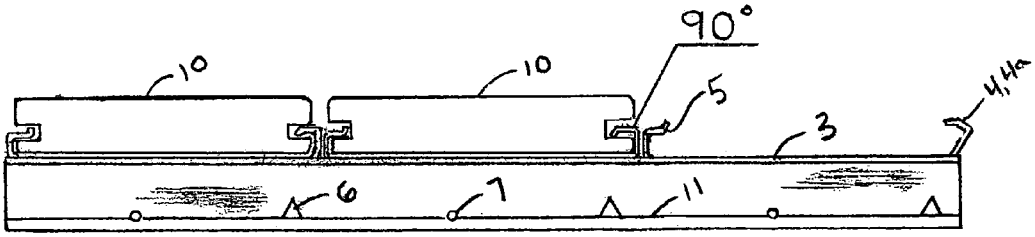
FIG. 5 is a side elevation view of a section of the fastening track in use, engaging slotted decking members via integrated receiving and fastening tangs.

Referring to FIGS. 3 and 5, an embodiment of the fastening track 3 is shown in more detail engaging/securing decking members 10. As noted above, "decking members" refers to elongated boards, planks, or other construction members having generally flat bottom and top surfaces, such as those suitable for use as a deck surface, regardless of materials from which the members are made or their method of manufacture. This definition includes composites, wood, polymers, laminates, and the like. Each decking member 10 to be engaged/secured by the present invention will contain elongated slots 9 running the length of one or both sides of the decking member 10. The slots 9 are typically formed 3/16" top to bottom (high) and 3/8" front to back (deep), placed in the center of the decking member 10 edge, so as to receive fastening and receiving tangs (4, 4*a*) and 5, respectively. When it is referred to herein that the decking member slots are "formed" in the decking members, this includes any manufacturing operation resulting in the creation of the slots or grooves, such as machining, molding, or the like.

The fastening track 3 includes a series of formed fastening tangs (4, 4*a*) and receiving tangs 5. When it is referred to herein that said fastening and receiving tangs 5 are "formed," this includes any manufacturing operation resulting in the creation of such functional tangs, such as machining, molding, or the like. Receiving tangs 5 are spaced repeatedly at approximately 5.5" on typical centers of top flat surface of the fastening track 3. Receiving tangs 5 have a vertical dimension of approximately 0.455", starting from the top panel of the track 3 to top of receiving tang 5. Receiving tangs 5 have a horizontal arm extending approximately 0.412 inches from back of vertical leg. The vertical legs of the receiving tangs 5 are set at 90 degrees to top panel of the track. The horizontal arms of the receiving tangs 5 are set at 90 degrees to the vertical legs.

After the fastening track 3 is pressed into position atop a supporting member 2, an initial decking member 10 is inserted into the track 3 by lowering the decking member 10 onto the receiving tang 5 of the track 3, such that the receiving tang 5 slips into the horizontal slot 9 along the decking member 10. The decking member 10 is then allowed to lay flat, abutting twin fastening tangs (4, 4*a*) opposite the receiving tangs 5. Once in this position, the fastening tangs (4, 4*a*) become aligned with the horizontal slot 9 along the side of the decking member 10. The twin fastening tangs (4, 4*a*) start in an "open" position in which the vertical leg of the fastening tangs (4, 4*a*) lies open at an approximate 120-degree angle, as shown in FIG. 6. Upon alignment of the horizontal slot 9 of a decking member 10 with the fastening tangs (4, 4*a*), the fastening tangs (4, 4*a*) are securely and permanently pressed into the horizontal slot 9 of the decking member 10—this is referred to as the "closed" position. When the fastening tangs (4, 4*a*) are engaged and in closed position, the vertical leg of the tangs (4, 4*a*) stand in an approximate vertical position, and the fastening tangs (4, 4*a*) are penetrating the lower surface of the decking member's 10 horizontal slot 9. When the fastening tangs (4, 4*a*) are in closed position, the dimensions are as follows: Top panel of the fastening track 3 to top of the fastening tangs (4, 4*a*) is approximately 0.337 inches with a 45-degree downturn measuring approximately 0.167 inches.

Once the fastening tangs (4, 4*a*) are securely engaged in an initial decking member 10, the process of installing the next decking member 10 is as follows: Align the horizontal slot 9 of the next decking member 10 with the next available receiving tang 5 on the track 3 and slide the decking member 10 forward into place, against the vertical leg of the receiving tang 5, such that the horizontal arm of the receiving tang 5 slips into the horizontal slot 9 along the decking member 10. When the decking member 10 is up against the vertical leg of the receiving tang 5, the decking member 10 is allowed to lie flat on the top panel of the track 3. At this point, the installation process repeats itself by bending the fastening tangs (4, 4*a*) into the closed position, as described herein and illustrated in FIGS. 6 and 7.

Because the individual fastening tracks are complementary in shape to the decking members 10, an embodiment of the present invention may be characterized as a decking system that includes first and second decking members 10 and a complementary-shaped fastening track 3 for securing the decking members 10 together and to a support member 2 that underlies and supports the decking members 10. As noted above, "decking members" refers to elongated boards, planks, or other construction members having generally flat bottom and top surfaces, such as those suitable for use as a deck surface, regardless of materials from which the members are made or their method of manufacture. At least one of the side edges of each decking member 10 has a longitudinal slot 9 formed therein. Subsequent to installation of the first and second decking members 10, a first longitudinal slot 9 formed in the first decking member 10 will lie laterally adjacent and opposed to a second slot 9 formed in the second decking member 10. The fastening track 3 includes a series of formed fastening tangs (4, 4*a*) and receiving tangs 5. Receiving tangs 5 are spaced repeatedly on the fastening track at approximately 5.5" on typical centers of top flat surface of the track 3. The horizontal arms of said receiving tangs 5 are set at 90 degrees to the vertical legs of said receiving tangs 5. When engaged, the horizontal arm of the receiving tangs 5 insert into the longitudinal slot of the decking members 10, securing the decking members 10 against the support member 2. Once the receiving tangs 5 are engaged, the fastening tangs (4, 4*a*) lying opposite the receiving tangs are securely and permanently pressed into the second horizontal slot 9 of the engaged decking member 10—this is referred to as the "closed" position. The fastening track 3 is connected to the support member 2 by way of integrated lower tangs 11 which dig into the supporting member. The fastening track 3 contains openings 7 for passage of elongated connectors for additional reinforcement of the fastening track's 3 connection to the supporting member 2.

It should be noted that the fastening track 3 corresponds to the shape and dimensions of the decking members 10, such that when the fastening track 3 (which lies atop and is attached to a support member 2) engages decking members 10, both the receiving tangs 5 and fastening tangs (4, 4*a*) extend into the decking member longitudinal slots 9, securing the decking members 10 to the fastening track 3, which in turn fastens the entire unit to the underlying supporting member 2. Thus, as noted above, the height of the receiving tangs 5 and fastening tangs (4, 4*a*) approximately correspond to the height of the decking member slot 9, as measured normally from the flat bottom surface of the decking member 10. Furthermore, the distances that the horizontal arms of the receiving tangs 5 extend out laterally from the vertical leg of the receiving tangs 5 such that they extend into the decking member 10 longitudinal slots 9 by at least a distance adequate to engage the decking members 10 in the slots 9.

The present invention has been described with reference to the preferred embodiment illustrated in the attached drawing figures, it is noted that equivalents may be employed and substitutions made herein without departing from the scope of the invention as recited in the claims. For example, the particular length of track 3 spacing and dimensions between receiving and fastening tangs, (4, 4*a*) and 5 respectively, may be modified, the specific angle (degrees) of fastening tangs (4, 4*a*) being modified to accommodate specific applications. Other similar dimensions and related aspects of said embodiment may be changed without departing from the original scope of the new invention. Since certain changes may be made in the above-described integrated decking member fastening track, without departing from the spirit and scope of the invention herein described, and since the invention may be characterized in more than one way without departing from the spirit and scope of the invention herein described, it is intended that all of the subject matter of the above description or shown in the accompanying drawings shall be interpreted merely as examples illustrating the inventive concept herein and shall not be construed as limiting the invention.

The embodiments of the invention in which an exclusive property or privilege is claimed are defined as follows:

1. A fastening track for securing laterally adjacent, slotted or grooved decking members to an underlying supporting member, said fastening track comprising: an elongated track having three planar surfaces, including a top panel and two side panels, wherein said top panel and two side panels arranged in such a way as to form a downwardly-facing channel; a series of receiving tangs, of which at least one includes a vertical leg and a horizontal leg, integrated with and extending generally outward from said top panel and a series of twin fastening tangs, separate and lying opposite from said receiving tangs, integrated with and extending generally outward from said top panel, said fastening tangs oriented at a first open angle prior to engagement with the slot or groove of a corresponding decking member and oriented at a second closed angle after engagement with the slot or groove of a corresponding decking member; a series of lower tangs integrated with and extending generally inwardly towards the downwardly-facing channel from both side panels; wherein at least one of said panels defines an opening for passage of an elongated connector; and wherein said receiving and fastening tangs are sized and shaped to engage said laterally adjacent decking members when said tangs are positioned into the horizontal slots formed in the sides of said decking members and said fastening track is connected to a supporting member that supports and lies beneath the laterally adjacent decking members.

2. The fastening track as set forth in claim 1, wherein each track has an aligning edge which ensures proper alignment of laterally adjacent tracks, and ensures accurate spacing of slotted or grooved decking members.

3. The fastening track as set forth in claim 1, wherein said side panels of said track supply a compression contact fit with supporting members via an inward, acute-angle bend of said side panels.

4. The fastening track as set forth in claim 3, wherein said compression contact fit also incorporates inwardly extending lower fastening tangs for securing said fastening track to a supporting member.

5. The fastening track set forth in claim 1, wherein a plurality of openings are incorporated into said top panel which allow for passage of additional elongated connectors for additional support to said supporting members.

6. The fastening track as set forth in claim 1, wherein multiple formed receiving tangs secure one side of slotted or grooved decking members to said fastening track.

7. The fastening track as set forth in claim 1, wherein multiple formed twin fastening tangs lie opposite said receiving tangs and secure slotted decking members to said fastening track.

8. The fastening track as set forth in claim 7, wherein said twin fastening tangs are initiated at a 120-degree open position to allow for slotted or grooved decking members.

9. The fastening track as set forth in claim 8, wherein said twin fasteners are bent into an 88-degree closed position using a tool, securing the leading edge of said fastening tangs into the lower, inside corner of said slotted or grooved decking members.

10. A decking system comprising: first and second laterally adjacent, decking members each having generally flat, generally parallel top and bottom surfaces linked by left and right longitudinal side edges, at least one of said side edges having a longitudinal slot or groove formed therein, wherein a first longitudinal slot formed in the first decking member lies laterally adjacent and opposed to a second slot or groove formed in the second decking member; and a fastening track for securing said laterally adjacent, slotted or grooved decking members to an underlying supporting member, said fastening track comprising: an elongated track having three planar surfaces, including a top panel and two side panels, wherein said top panel and two side panels arranged in such a way as to form a downwardly-facing channel; a series of receiving tangs, of which at least one includes a vertical leg and a horizontal leg, integrated with and extending generally outward from said top panel and a series of twin fastening tangs, separate and lying opposite from said receiving tangs, integrated with and extending generally outward from said top panel, said fastening tangs oriented at a first open angle prior to engagement with the slot or groove of a corresponding decking member and oriented at a second closed angle after engagement with the slot or groove of a corresponding decking member; a series of lower tangs integrated with and extending generally inwardly towards the downwardly-facing channel from both side panels; wherein at least one of said panels defines an opening for passage of an elongated connector; and wherein said receiving and fastening tangs are sized and shaped to engage said laterally adjacent decking members when said tangs are positioned into the horizontal slots formed in the sides of said decking members and said fastening track is connected to a supporting member that supports and lies beneath the laterally adjacent decking members.

11. The decking system as set forth in claim 10, wherein each track has an aligning edge which ensures proper alignment of laterally adjacent tracks, and ensures accurate spacing of slotted or grooved decking members.

12. The decking system as set forth in claim 10, wherein said side panels of said track supply a compression contact fit with supporting members via an inward, acute-angle bend of said side panels.

13. The decking system as set forth in claim 12, wherein said compression contact fit also incorporates inwardly extending lower fastening tangs for securing said fastening track to a supporting member.

14. The fastening track set forth in claim 10, wherein a plurality of openings are incorporated into said top panel which allow for passage of additional elongated connectors for additional support to said supporting members.

15. The decking system as set forth in claim 10, wherein multiple formed receiving tangs secure one side of slotted or grooved decking members to said fastening track.

16. The decking system as set forth in claim 10, wherein multiple formed twin fastening tangs lie opposite said receiving tangs and secure slotted decking members to said fastening track.

17. The decking system as set forth in claim 16, wherein said twin fastening tangs are initiated at a 120-degree open position to allow for slotted or grooved decking members.

18. The decking system as set forth in claim 17, wherein said twin fasteners are bent into an approximate vertical closed position using a hammer or other appropriate tool, securing the leading edge of said fastening tangs into the lower, inside corner of said slotted or grooved decking members.

* * * * *